United States Patent [19]

Palmer et al.

[11] Patent Number: 4,768,280

[45] Date of Patent: Sep. 6, 1988

[54] ROLL FORMING OF METAL ARTICLES

[75] Inventors: Ross L. Palmer, Eight Mile Plains; Leslie H. Palmer, Mount Gravatt, both of Australia

[73] Assignee: Palmer Tube Mills (Aust.) Pty. Ltd., Brisbane, Australia

[21] Appl. No.: 36,669

[22] PCT Filed: Jul. 31, 1986

[86] PCT No.: PCT/AU86/00217

§ 371 Date: May 13, 1987

§ 102(e) Date: May 13, 1987

[87] PCT Pub. No.: WO87/00773

PCT Pub. Date: Feb. 12, 1987

[30] Foreign Application Priority Data

Jul. 31, 1985 [AU] Australia ..... PH01735

[51] Int. Cl.[4] ..... B23P 17/00; B05B 13/00

[52] U.S. Cl. ..... 29/527.4; 29/33; 15/88; 15/104.04; 118/DIG. 11; 118/317; 427/383.7

[58] Field of Search ..... 15/88, 104.03, 104.04; 29/527.4, 33 D; 118/DIG. 11, 317, 318; 427/383.7; 198/427, 430

[56] References Cited

U.S. PATENT DOCUMENTS

| | | | |
|---|---|---|---|
| 2,683,436 | 7/1954 | Marantz | 118/317 X |
| 2,794,448 | 6/1957 | Marantz | 118/317 X |
| 2,826,235 | 3/1958 | Gudmestad | 153/54 |
| 3,044,907 | 7/1962 | Bernhardt | 118/DIG. 11 |
| 3,559,280 | 2/1971 | Mailhiot et al. | 29/527.4 |
| 3,561,096 | 2/1971 | Krengel et al. | 427/383.7 X |
| 3,620,952 | 3/1971 | Chiappe | 204/198 |
| 3,696,503 | 10/1972 | Krengel et al. | 29/527.4 |
| 3,927,816 | 12/1975 | Nakamura | 29/527.4 X |
| 4,002,144 | 1/1977 | Lang et al. | 118/630 |
| 4,273,798 | 6/1981 | Scheiber | 118/317 X |
| 4,290,841 | 9/1981 | Fukuhara | 156/464 |
| 4,441,238 | 4/1984 | Hijuelos et al. | 15/88 X |
| 4,621,399 | 11/1986 | Qureshi et al. | 29/527.4 X |

FOREIGN PATENT DOCUMENTS

| | | | |
|---|---|---|---|
| 8971/55 | 11/1955 | Australia . | |
| 20621/76 | 8/1979 | Australia . | |
| 2306851 | 3/1975 | Fed. Rep. of Germany . | |
| 431027 | 6/1935 | United Kingdom . | |
| 1429091 | 3/1976 | United Kingdom . | |
| 2042374 | 9/1980 | United Kingdom | 118/DIG. 11 |

OTHER PUBLICATIONS

Tool and Manufacturing Enginee—s Handbook, vol. 2–"Forming", 4th Ed.–Published by SME.

Metals Handbook, 8th Ed., vol. 14, "Forming", Published by A.S.M.

Encyclopedia of Materials Handling by Woodley, vol. 1–Pergamon Press, 1964.

Japatic English Language Abstract (Hitachi Kinzoku K.K.) , Oct. 2, 1981; 56–126025.

*Primary Examiner*—P. W. Echols

*Assistant Examiner*—Carl J. Arbes

*Attorney, Agent, or Firm*—Renner, Otto, Boisselle & Sklar

[57] ABSTRACT

A roll forming process utilizes as a feedstock hot rolled steel strip (1) and during the roll forming process the surface of the steel strip (1) is cleaned and polished by the combined effects of deformation and frictional contact between the surface of the strip (1) and the mill rollers. The initial deformation step (9) is carried out in the presence of a conventional rolling mill lubricant-/coolant and the final rolling stage (10) is carried out in the presence of a detergent composition which serves to remove any residual lubricant and particles of mill scale and at the same time act as a lubricant/coolant for the rolling mill (8) at the final stage (10). The process enables subsequent on-line painting (13) of the roll formed product (12) at high line speeds.

29 Claims, 4 Drawing Sheets

ROLL FORMING OF METAL ARTICLES

THIS INVENTION is concerned with the roll forming of metal articles from hot rolled steel strip.

BACKGROUND OF THE INVENTION

In the manufacture of roll formed steel articles the feedstock may be hot rolled or cold rolled steel strip. Hot rolled steel strip when supplied from the steel mill is coated with a tough skin of steel oxide (predominately $Fe_3O_4$) known as "mill scale" oxide while cold rolled steel is usually supplied with a smooth surface free of blemishes ("bright" steel).

To enable the later application of decorative or protective surface finishes such as paint or electroplating to the roll formed article it is customary to remove mill scale from hot rolled strip by immersion in a pickling bath. Pickling may be carried out on the coil of steel strip before the roll forming process or the roll formed articles may be pickled prior to surface finishing.

The pickling process however has largely fallen into disfavour due to its excessive and costly consumption of time, energy and pickling chemicals and at the same time creates an environmental problem in the disposal of spent chemicals. Further difficulties associated with the pickling process relate to the creation of surface defects such as pitting in the treated surface and the effective de-passivation of the steel leading the surface corrosion on the strip coils before rolling as well as on the roll formed products. Although surface corrosion may be alleviated by treating the strip coils or the roll formed articles with protective film of a mineral or synthetic oil, there are further costs and environmental problems associated with the removal and disposal of the protective oil.

In order to alleviate the problems associated with roll forming of hot rolled steel, it has been proposed to produce a clean bright steel by cold rolling the hot rolled strip.

In cold rolling of steel strip, the coil may be pickled to remove the major portion of adhering mill scale and then passed through a four or five roll mill to produce a steel strip of superior dimensional tolerances. During the cold rolling operation a lubricant such as mineral oil or synthetic oil is used and this must be removed from the surface of the strip before or during the subsequent high temperature annealing process to avoid surface carburization.

Lubricant removal may be effected by a variety of methods. The coils, coated in lubricant, may be annealed in a carefully controlled atmosphere of steam, nitrogen and hydrogen to remove the carbon residues from the surface of the strip. Alternatively the rolling mill lubricant may comprise a low boiling point composition which evaporates during the annealing process.

Other lubricant removal processes are effected by spraying onto the surface of the steel strip detergent compositions either just before entry into the last roll stand or just after exit. Although detergents are generally satisfactory for removal of lubricant and adhered metal particles from the strip surface, the use of detergents is known to cause problems in a cold rolling mill due to a marked decrease in lubricity which in turn causes production of a large amount of metallic particles on the strip surface.

The problems associated with the use of detergents for removal of lubricating oils are addressed in Australian Pat. No. 552870. In Australian Pat. No. 552870 it is stated that the "problems caused by the detergent method" using water or a detergent can be solved by injecting at high pressure a rolling mill lubricant emuslion of the concentration of 0.5–2.0% onto the surface of the strip at the entrance or exit of the last stand and injecting at a low pressure a rolling mill lubricant emulsion of the same concentration to the rolls as a lubricant.

Australian Pat. No. 552870 also suggests that in the prior art high pressure detergent method, an oil separator is necessary for recovery of the oil and detergent for later use.

Although certain economies may be achieved by utilizing hot rolled steel strip as feedstock for roll forming, most of these economies are lost with prior art processes. Roll formed articles produced from hot rolled steel strip posses a rough surface due to the adhesion of mill scale flakes as well as a certain amount of residual mill lubricant. Such roll formed articles often exhibit a considerable degree of surface rust after subsequent storage and transportation.

Accordingly before such roll formed articles may be utilized in structural applications or other applications including furniture manufacture, considerable time, effort and cost is expended in preparing the surface of the articles to accept a protective or decorative surface finish such as paint or the like. Residual mill scale must be removed by pickling or brushing, sand blasting or the like and residual lubricant may be removed by solvent or alkali stripping processes.

In the light of the high costs associated with the subsequent surface finishing of articles roll formed from hot rolled steel strip most roll forming processors prefer to use cold rolled steel strip notwithstanding its higher initial cost as a feedstock. Cold rolled steel strip is usually supplied to a roll forming mill with a protective coating of mineral oil or the like to prevent surface rusting during transportation and storage prior to the roll forming operation.

Similarly, the roll formed product is usually supplied to a steel fabricator with a protective coating of mineral oil to prevent surface rusting. The steel fabricator must therefore remove the oil film by expensive solvent or alkali stripping processes and then the roll formed product has a protective primer applied thereto by hand brushing, spray painting or the like.

Although it has previously been proposed to apply a surface coating such as a metal primer paint to roll formed articles during the roll forming process, such prior art "in line" rolling and painting processes have been quite unsatisfatory.

In prior art processes using hot rolled steel strip it has been proposed to use and sand blasting and alkali treatment stations after the rolling mill and then to paint the severed lengths "off line". This process is extremely inefficient as in order for the sand blasting and alkali treatment processes to be effective the line speed of the rolling mill must be substantially reduced. In addition the process consumes large amounts of energy and materials and creates environmental problems in disposal of spent chemicals. A further difficulty arises in the need for additional storage and handling space to paint the sections off line with consequent high additional labour costs and environmental problems caused by evaporating solvents in the paint region.

SUMMARY OF THE INVENTION

The present invention provides a method and apparatus which permits the utilization of hot rolled steel strip as a feedstock in a roll forming operation and also permits surface coating of the roll formed articles "in line" at the effective maximum line speed of the rolling mill.

The invention also is concerned with the roll forming of articles from hot rolled steel strip whereby the roll formed product is produced with a clean bright surface suitable for subsequent surface finishing.

The invention permits painted or surface coated roll formed products to be handled at the take-off end of the roll forming and coating line by conventional handling and packing procedures without the necessity for any additional workspace or additional labour. The invention also permits subsequent fabrication of the coated product without the need for any pretreatment by the steel fabricator.

The present invention aims to alleviate the problems associated with the manufacture of roll formed articles and in particular to roll forming of articles made from hot rolled steel strip. As used hereinafter the expression hot rolled steel strip relates to unpickled hot rolled steel strip in the form as produced from a hot rolling mill with a substantial portion of mill scale adhered thereto.

According to one aspect of the invention there is provided a method for roll forming of articles from hot rolled steel strip comprising the steps of:

deforming a hot rolled steel strip to fracture and/or loosen a layer of mill scale adhered thereto;

shaping said steel strip in a shaping region of a roll forming mill to a predetermined shape in the presence of a roll forming lubricant; and, sizing said predetermined shape in a sizing region of said roll forming mill in the presence of a detergent to remove particles of mill scale and lubricant adhering to said predetermined shape, said detergent acting as a lubricant for sizing rolls in said sizing region.

The steel strip may be deformed in a deforming region separate from or integral with the roll forming mill. Preferably the deforming region comprises said shaping region.

Suitably a collection tank is provided below the shaping region to facilitate collection and recirculation of the lubricant solution. Similarly a collection tank is provided below the sizing region to facilitate collection and recirculation of the detergent solution.

Preferably means are associated with the collection tanks below the shaping and sizing regions to separate particles of mill scale from respective lubricant and detergent solutions.

If required, removal means is provided between said shaping region and said sizing region to remove excess lubricant from the shaped section. The removal means may comprise a washing station and/or a wiping station.

A mechanical or gas wiping station may be employed at the exit end of the shaping region to assist in removal of excess lubricant and a mechanical or gas wiping station may be employed at the exit end of the sizing region to remove excess detergent.

If required a chemical treatment station may be positioned adjacent the exist end of the sizing region to chemically treat the surface of the roll formed steel section. Preferably the chemical treatment station includes means for applying a passifying agent etchant or the like to the surface of the steel section. Most preferably the chemical treatment station employs a phosphate steel etchant.

According to another aspect of the invention there is provided an apparatus for continuous in-line forming and coating of roll formed articles from hot rolled steel strip, said apparatus comprising:

a roll forming mill for forming a substantially continuous roll formed section, said mill having a deforming and/or shaping region and a sizing region, said deforming and shaping region being adapted to remove in the presence of a lubricating coolant at least a portion of a layer of mill scale adhering to the surface of the steel strip and said sizing region being adapted to remove in the presence of a detergent coolant acting as a lubricant for the sizing rolls the remainder of any adherent mill scale;

a chemical treatment region for chemically preparing for coating the surface of a roll formed section issuing from said roll forming mill;

a coating application region for applying a surface coating to said roll formed section issuing from said chemical treatment region;

a drying region for drying or curing said surface coating on said roll formed section issuing from said coating application region;

severing means for severing said substantially continuous section into predetermined lengths; and accumulation means for accumulating predetermined lengths of roll formed section for subsequent handling operations, said apparatus characterized in that each of said roll forming mill, chemical treatment region, coating application region, drying region and severing region operates at a substantially identical line speed.

Suitably the coating application region comprises a paint application means. The paint application means may comprise a gas powered paint application, an electrostatic paint applicator, an airless paint applicator or a powder paint applicator.

Preferably the apparatus comprises an electrostatic paint applicator having a plurality of application nozzles.

The drying region may comprise heating means such as infra red irradiators or it may comprise or optionally include a source of heated gas such as air. If required the drying region may comprise a source of electromagnetic irradiation other than the infra red frequency band.

In yet a further aspect of the invention the continuous roll forming/coating apparatus may comprise:

a roll forming mill and chemical treatment region as described above;

a severing means adjacent said chemical treatment region for severing into predetermined lengths roll formed section issuing from said chemical treatment region, said roll forming mill, chemical treatment region and said severing means all operating at a first line speed;

an accumulator for accumulating severed lengths of roll formed section issuing from said severing means;

transfer means for transferring a plurality of severed lengths to a conveyor means;

a coating application means for coating simultaneously a plurality of severed lengths of roll formed section; and, a drying region for drying simultaneously a plurality of severed lengths of roll formed section, said transfer means, coating application means and drying region each operating at a second line speed; said second line speed being proportional to the ratio of the first line speed and the unit number of severed lengths transferred by said transfer means.

BRIEF DESCRIPTION OF THE DRAWINGS

In order that the various aspects of the invention may be fully understood, reference will now be made to the accompanying drawings in which.

DETAILED DESCRIPTION

Figure 1:
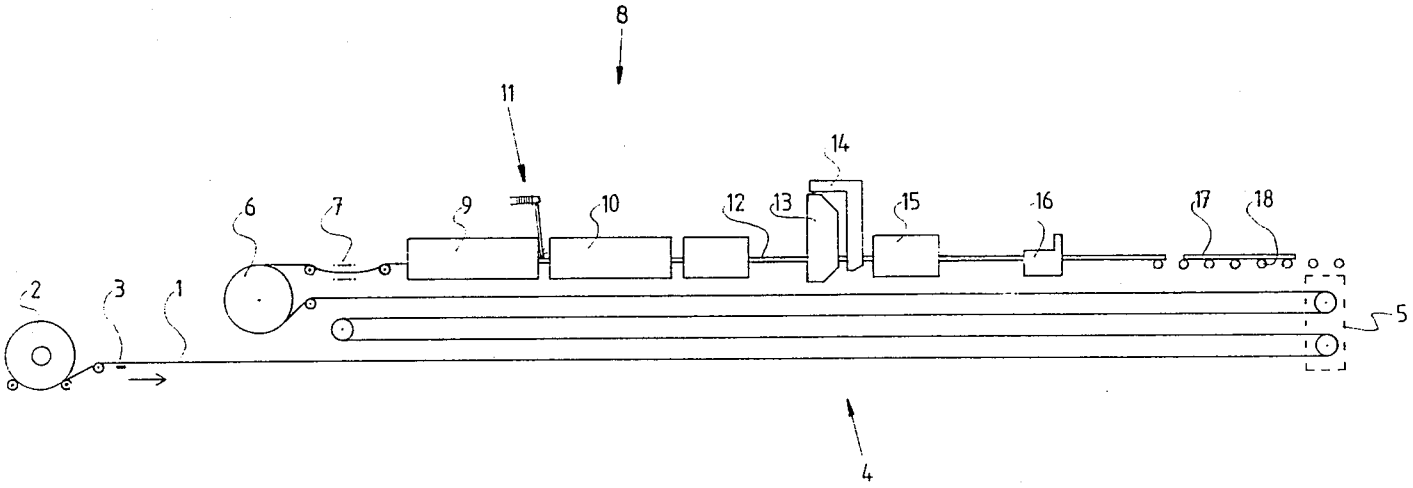
FIG. 1 shows a roll forming mill and chemical treatment station according to one aspect of the invention.

In FIG. 1 a strip of hot rolled steel 1 is fed from a coil 2 via a strip joining station 3 to a take up festoon assembly 4. The festoon assembly 4 comprises travelling idler rollers 5 which enable continuous operation of the rolling mill while a fresh coil 2 is joined to the tail of a preceding roll at the joining station by butt welding the respective ends of the strips.

After leaving the festoon assembly 4 the strip 1 passes over a supply capstan 6 and thence to a tension control detector 7 before entering the rolling mill 8.

Rolling mill 8 comprises a deforming and/or shaping region 9 and a sizing region 10. As the strip 1 enters the deforming and/or shaping region 9 the flat strip is progressively bent by a series of rollers until it assumes a desired shape such as a tube of circular cross section. During the initial deforming and shaping process the layer of mill scale on the steel strip is cracked and loosened. A substantial portion of the mill scale is removed in the deforming and shaping region by the combined actions of deformation of the steel strip and the friction between the strip and the deforming and/or shaping rolls. The deforming and/or shaping rolls are continuously sprayed with an emulsified mineral oil coolant/lubricant which serves to lubricate the rolls and to remove at least some of the mill scale.

After leaving the deforming and/or shaping region 9 the tubular cross section with abutting free edges passes to a welding station 11 where the free edges of the strip are welded together to form a sealed tube.

The tubular member then passes to a sizing region 10 where a series of sizing rollers roll the tubular member accurately to a predetermined diameter. In the sizing region 10 the conventionally used lubricating oil emulsion is replaced with a detergent solution. The detergent solution has been found to provide quite adequate lubrication and cooling for the sizing rolls and at the same time the detergent solution removes any residual traces of lubricating oil and mill scale.

After leaving the sizing regin 10, the tubular member then passes into a chemical treatment region wherein the surface of the tube is treated with a passifying etching solution such as a phosphating compound to assist in the subsequent bonding of the painted coating. At this juncture the tube has a bright clean surface free from such blemishes as residual mill scale, corrosion and other surface stains.

The tube 12 then passes to a painting station 13 wherein a paint composition such as a zinc oxide primer is applied by spray guns or the like. The paint may comprise any suitable quick drying vehicle such as alkyd, polyester, epoxy, polyurethane resins, etc, and may be applied by any suitable spraying process such as airless spraying, electrostatic spraying, etc. A fume collection hood 14 directs any solvents recovered from the painting and drying regions to a scrubber or solvent recovery system (not shown). After leaving the painting station 13 the tube 12 passes to a drying station 15 where the painted surface of the tube 12 is dried by infra red radiators to at least a touch-dry finish.

The painted tube then passes to a severing station 16 to be cut into predetermined lengths by a flying saw or the like.

Severed lengths of painted tube 17 at then conveyed by a roller conveyor or the like to subsequent stations for end finishing inspection and packaging.

Each of the components in the tube forming painting and severing line is connected to a master control and sensors are provided at various positions to monitor such features as weld integrity, line speed, tube dimensions, etc. These functions are conventional on modern high speed roll forming mills and thus are not described herein in detail.

It has been found that with line speeds in excess of 150 meters/minute excellent properties are obtainable in the painted product. The paint coating when tested by conventional test methods shows excellent adhesion and low porosity making the tube suitable for use without subsequent off-line painting and finishing.

Figure 2:
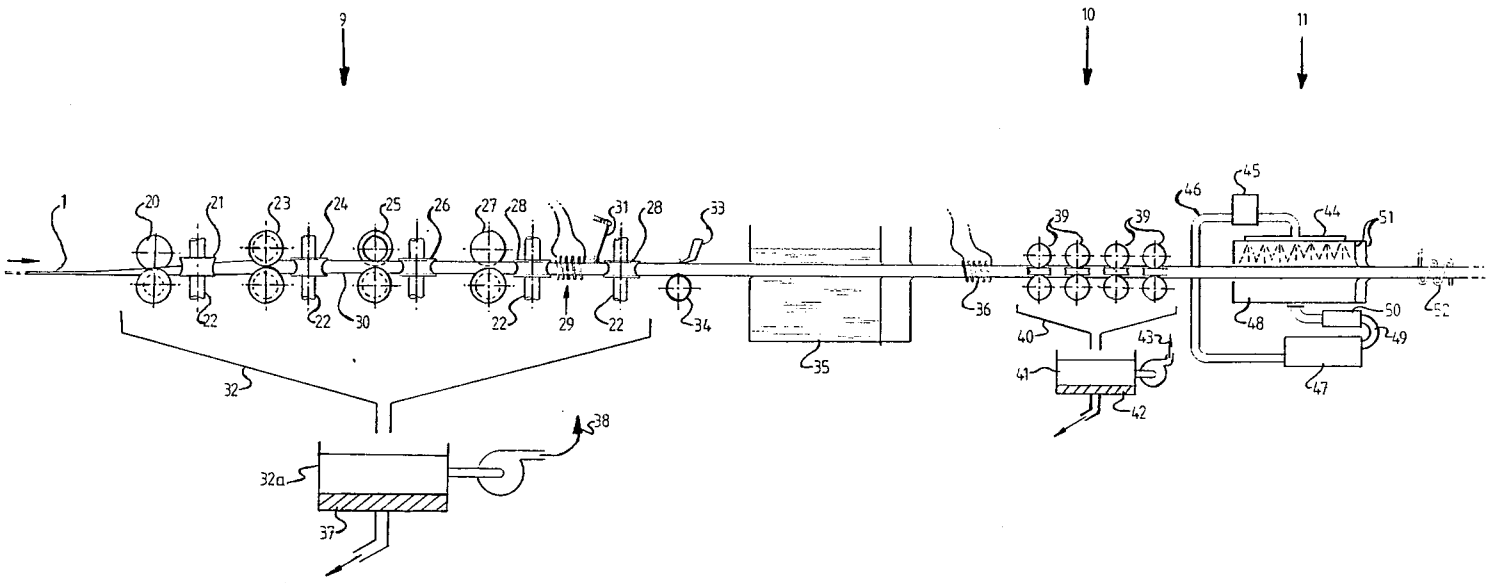
FIG. 2 shows schematically a continuous tube forming apparatus adapted for in line painting of the roll formed tube according to another aspect of the invention.

FIG. 2 shows in greater detail the deforming and/or shaping region 9, the sizing region 10 and the chemical treatment region 11.

The flat strip 1 enters the deforming/shaping region 9 where it is engaged by a succession of rollers wherein top and bottom forming rollers 20, side rollers 21 rotatable on associated support axles 22, and subsequent roller sets 23–28 all function as forming rollers as shown to form a tubular cross section with abutting edges. In roller set 20 the top roller is convex and bottom roller is concave as shown while each roller in sets 21–28 is concave. Rollers 25 include a projecting flange which extends into tube 30 for trimming the edges of the open seam. The tube 30 then passes through forming rollers 26 mounted on associated axles 64 before the seam is engaged by guide rollers 27 before being gripped by first and second sets of pinch rollers 28 to hold the open seam together while passing through welding zone 29 interposed between pinch roller sets 28. The welding is carried out by a high frequency coil 31 in conjunction with a consumable ferrite rod.

Mill coolant/lubricant recirculating from spraypan 32 is applied to the forming rollers 20–28 and the tube 30. A scarfing tool 33 in conjunction with support roller 34 facilitates the removal of a welding bead before the tube passes through a water bath 35 for quenching and stress relief in the weld region. The tube 30 then passes through a weld integrity testing apparatus 36. During the deformation and shaping of the steel strip, a substantial portion of the mill scale is removed by the combined effects of deformation and friction between the mill rolls and the surface of the strip 1. Recirculating coolant/lubricant washes the mill scale into a separator 32*a* to separate the particles of mill scale 37 from the recirculating coolant/lubricant 38.

The tube 30 then passes through a set of sizing rollers 39 in sizing region 10 arranged to provide accurate shaping and dimensions of the tube and also to facilitate the removal of any residual mill scale or result. Instead of a conventional oil lubricant emulsion a detergent solution is utilized to cool and lubricate the sizing rollers 39 and tube 30 in the sizing region 10. Recirculating detergent solution is collected in spray pan 40 and passed to a separator 41 to separate mill scale 42 from the recirculating detergent composition 43.

The tube 30 then passes through chemical treatment station 11 wherein a phosphate etchant is sprayed onto the surface of tube 30 by spraybar 44. The etchant is pumped by pump 45 through line 46 from tank 47. The etchant is returned from spray housing 48 through return line 49 after passing through filter 50 as as to provide a continuous circulation of etchant. Excess etchant is removed by rubber wiper 51. After the application of etchant the tube 30 is dried by an air wiper 52.

Figure 3:
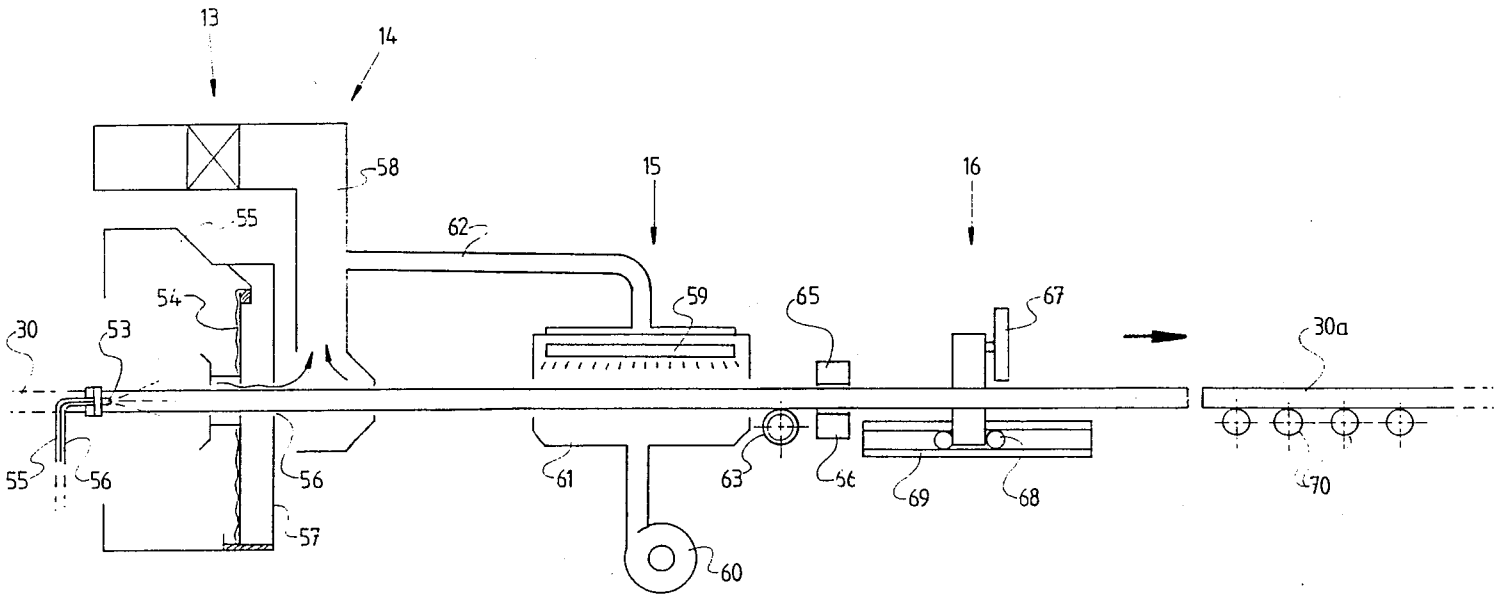
FIG. 3 shows the paint application and drying regions of FIG. 2 together with the severing means.

Referring now to FIG. 3, the tube 30 then passes through painting station 13 wherein sprayguns 53 are oriented at an angle of about 45 degrees to tube 30. Overspray is collected by water curtain 54 and after separation is returned through lines 55 and 56 to spraygun 53. The tube 30 passes through an aperture 56 in the rear wall 57 of housing 55. Solvents and other volatile products are removed from the spray housing 55 and the surface of the tube as it emerges from the housing 55. The volatile products may be passed to a scrubber or solvent recovery unit (not shown) via duct 58.

The tube 30 then passes through drying zone 15 wherein infra red heaters 59 are directed towards the surface of the painted tube. Also shown is air blower 60 which directs heated air onto the paint surface to assist in the drying process. Volatile gases are passed from the dryer housing 61 via duct 62 to duct 58.

At the exit end of drier housing 61 is located a support roller 63 comprised of or coated with PTFE or a similar heat resistant low friction material. At this point the tube 30 has travelled from the sizing region 10 to support roller 63 without any support or contact and this enables the maximum opportunity for the surface skin of the painted surface to toughen sufficiently for mechanical contact without affecting the integrity of the painted surface.

As the tube enters the painting station 13 with a substantial amount of residual heat from the welding zone 29 this assists the paint in drying evenly throughout rather than just forming a surface skin which otherwise retards the drying process.

The painted tube 30 finally passes through a cooling zone 65 wherein chilled water and/or chilled gas or air may be applied to painted tube 30 as it passes through housing 66. The tube 30 then passes to a flying saw 67 which accelerates to the same speed as the tube 30 to cut tube 30 at predetermined lengths. The saw 67 is supported by rollers 68 in track 69 as shown. Finally the cut lengths of painted tube **30*a* are transported away from severing region 16 by transport rollers 70** which suitably rotate at a slightly higher line speed than the line speed of the remainder of the line.

The tube lengths are then collected in a collection region (not shown) for final inspection and if required end trimming prior to packaging for transportation and storage. By the time the painted lengths of the tube emerge from cooling station 65 the surface of the paint is sufficiently durable for subsequent handling operations without abrasion or penetration through to the surface of the steel.

It can be seen therefore that the use of hot rolled steel strip in conjunction with the use of a detergent coolant/lubricant in the sizing region of a rolling mill and subsequent phosphating provides a rolled steel product having a surface suitable for subsequent surface finishing without the need either for off-line pretreatment or post-treatment. This aspect of the invention in its provision of a clean blemish free surface on a roll formed product produced from hot rolled steel strip enables the second aspect of the invention to be utilized in the high speed in line painting of a continuous roll formed steel product.

It will be readily apparent to a skilled addressee that although the preferred embodiments of the invention have been described with reference to the production of a rolled steel tube, both aspects of the invention are applicable to other rolled steel products. Such other rolled steel products may include rectangular section tube, "C" and "U" shaped steel channels and other complex cross sectional shapes.

All that is required to modify the process described above is to provide sufficient deformation to the hot rolled steel strip (either in a longitudinal and/or transverse direction) to enable initial cracking and loosening of the adhered mill scale and subsequent abrasion by deforming and/or shaping and sizing rollers. This may be achieved by passing the hot rolled steel strip through a series of deforming rollers prior to entry into a conventional or suitably modified roll forming mill.

It is further envisaged that roll or press formed sheet metal products may also be produced from hot rolled steel sheet according to the invention. Such products may include for example sheet metal roofing tile panels, etc.

Futher modifications of the invention are described with reference to FIGS. 4 and 5 of the drawings.

Figure 4:
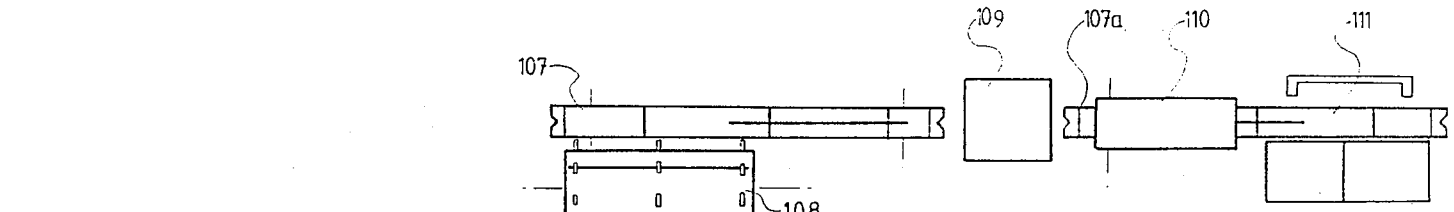
FIG. 4 shows schematically an alternative form of this apparatus shown in FIG. 2.

FIG. 4 shows diagrammatically a rolling mill line for the continuous production of roll formed steel products from hot rolled steel strip. Hot rolled steel strip (not shown) is passed through a rolling mill having a deforming and/or shaping region 100, a welding region 101 (if required), a quenching region 102 (if required), a sizing region 103 and an etching or passifying station 104 as generally described above.

At the exit from the passifying station 104 is situated a flying saw or similar severing means 105 and a run-out region 106 to receive lengths of tube cut to predetermined lengths.

Cut lengths of tube are transferred singly from the run out region to a conveyor 107 by a rotating drum-like transfer mechanism rotating about an axis parallel to and intermediate the run out region 106 and the conveyor 107. The rotary transfer drum has spaced axially projecting fingers which lift the cut lengths of tube from the run out region 106 and by rotation of the drum-like transfer means the cut lengths of tube are then deposited on the driven conveyor 107 running at a line speed slightly greater than the rolling mill.

The conveyor comprises a plurality of knife edge projections running transversely of the direction of travel of the conveyor and each projection having a notch to receivably locate the tube.

The conveyor 107 then directs the tube (unsupported) through a painting station 109 onto a further knife edge conveyor **107*a* and thence through a drying station 110 generally described above and thence to an accumulator region 111** for subsequent end trimming and packing operations.

It has been found that although the cut lengths of tube make point contact with the notched regions of the knife edge projections of the conveyor, there is sufficient surface tension in the paint layer to fully cover the surface of the tube without residual unpainted portions corresponding to the conveyor.

The tube is unsupported during its passage through the painting station 109 to ensure complete paint converage of the entire surface of the tube.

Although the embodiment described above is not strictly "in-line" as with the embodiment of FIGS. 1–3, the tube may nevertheless be painted and subequently packed at the normal line speed of the rolling mill without any intermediate handling process.

Figure 5:
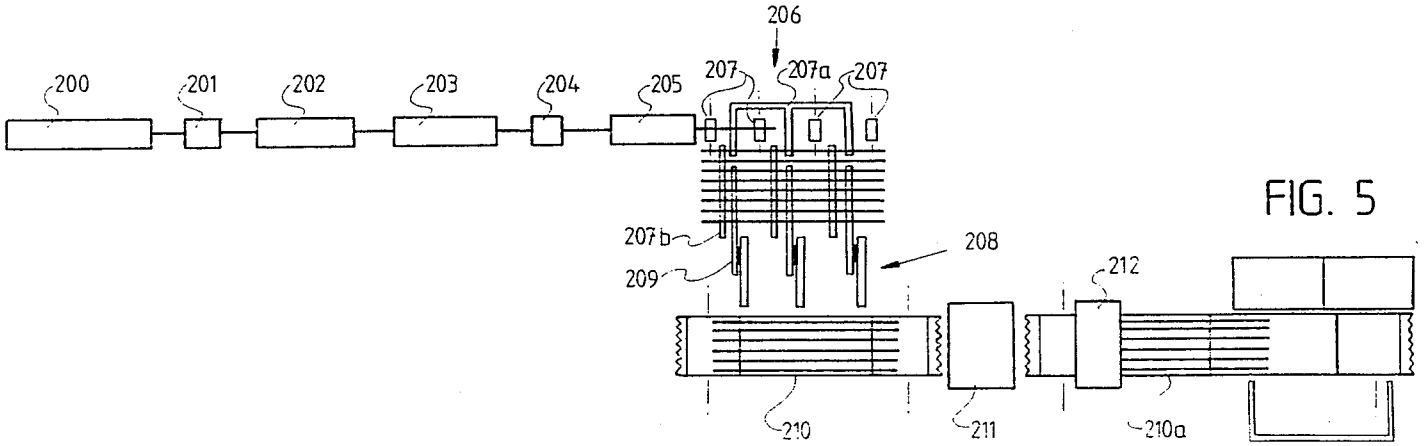
FIG. 5 shows schematically yet a further alternative form of the apparatus shown in FIG. 2.

FIG. 5 shows yet another embodiment of the invention. The apparatus comprises a roll forming mill having a deforming and/or shaping region 200, a welding region 201 (if required), a quenching region 202 (if required), a sizing region 203 and an etchant/passifier application station 204 generally as described with reference to FIG. 1–3.

A flying saw or like severing means 205 cuts the tubes into predetermined lengths which are transferred to a collection region 206 by roller conveyors 207. A first short amplitude reciprocating walking beam conveyor 207*a* then transfers each tube collected progressively transversely of the collection region 206 until a plurality, say eight, tubes are supported in spaced parallel juxtaposition on notched transverse stationary support members 207*b*.

A second long amplitude reciprocating walking beam 208 having transverse beams 209 notched at similar spaces to the stationary support members is located between collection region 206 and a further conveyor 210. The second reciprocating walking beam is adapted to elevate and transfer to conveyor 210 a plurality, say six, tubes, in one motion whereby the plurality of tubes is placed in spaced parallel juxtaposition on the conveyor 210.

Like the conveyor system of FIG. 4 the conveyor 210 comprises a plurality of transverse notched knife edges to receivably locate edge tube and thereby maintain their spaced relationship.

The plurality of tubes is then passed via painting station 211 to a similar knife edge conveyor 210*a* which then conveys the plurality of tubes via drying station 212 to an accumulator for subsequent handling. If required, the notched regions of the knife edge conveyor may comprise or be coated with a PTFE or like heat and abrasion resistant material.

By handling the cut lengths of tubing as a group of, say six, the speed of conveyor 210 and 210*a* may be reduced in direct proportion to the line speed of the rolling mill i.e. one-sixth or slightly greater than one-sixth. In this manner cut lengths of tubing may be painted and dried at substantially lower line speeds and yet enable continuous production of an in-line type. Accordingly slower drying paints or surface coatings may be employed if a range of differing surface finishes is required. The conveying, painting and handling systems of FIGS. 4 and 5 may be adapted for use with conventional roll forming apparatus utilizing clean cold rolled steel strip.

By employing multiple painting systems associated with the painting stations of any of the previously described embodiments, almost instantaneous colour or paint type changes may be effected. It is envisaged that the paint station may also be adapted to enable coating of the roll formed articles of various spray metallization processes including vacuum metallization or by plasma coating techniques.

It will be readily apparent to a skilled addressee that many variations and modifications will be possible with the various aspects of the invention without departing from the spirit and scope thereof.

What is claimed is:

1. A method for roll forming of articles from hot rolled steel strip comprising the steps of:

deforming a hot rolled steel strip to fracture and/or loosen a layer of mill scale adhered thereto:

shaping said steel strip in a shaping region of a roll forming mill to a predetermined shape in the presence of a roll forming lubricant; and, sizing said predetermined shape in a sizing region of said roll forming mill in the presence of a detergent to remove particles of mill scale and residual roll forming lubricant adhering to said predetermined shape, said detergent acting as a lubricant for sizing rolls in said sizing region.

2. A method as claimed in claim 1 wherein said steel strip is deformed in a deforming region separate from said roll forming mill.

3. A method as claimed in claim 1 wherein said steel strip is deformed in a deforming region integral with said roll forming mill.

4. A method as claimed in claim 1 wherein at least portion of said mill rolling lubricant is removed from the surface of the roll formed article between said shaping and sizing regions.

5. A method as claimed in claim 4 wherein detergent used as a cleaning and lubricating agent in said sizing region is recirculated from a collection means located below said sizing region.

6. A method as claimed in claim 5 wherein particulate material is separated from said detergent prior to recirculation.

7. A method as claimed in claim 1 wherein the surface of the roll formed article is chemically treated after sizing to facilitate surface coating of said article with a surface coating composition.

8. A method as claimed in claim 7 wherein said article is chemically treated with a phosphate etchant.

9. A method as claimed in claim 8 wherein said article is continuously coated in-line with a surface coating composition applied to said article while said article is travelling at the same line speed as the roll forming mill.

10. A method as claimed in claim 9 wherein said article is continuously coated by spraying with a paint composition.

11. A method as claimed in claim 10 wherein said article is subjected to infra-red irradiation to dry a paint composition coated on the surface of the article.

12. A method as claimed in claim 11 wherein at least portion of said infra-red irradiation in derived from heat energy introduced into said article prior to coating with a paint composition.

13. A method as claimed in claim 12 wherein said article is unsupported between a region of chemical treatment and a region after said article is subjected to infra-red irradiation.

14. An apparatus for continuous in line forming and coating of roll formed articles from hot rolled steel strip, said apparatus comprising:

a roll forming mill for forming a substantially continuous roll formed section, said mill having a deforming and/or shaping region and a sizing region, said deforming and/or shaping region being adapted to remove in the presence of a mineral oil lubricating emulsion at least portion of a layer of mill scale adhering to the surface of the steel strip and said sizing region being adapted to remove in the presence of a detergent composition acting as a lubricant for sizing rolls in said sizing region the remainder of any adherent mill scale;

a chemical treatment region for chemically preparing for surface coating the surface of a roll formed section issuing from said roll forming mill;

a coating application region for applying a surface coating to said roll formed section issuing from said chemical treatment region;

a drying region for drying said surface coating on said roll formed section issuing from said coating application region;

severing means for severing into predetermined lengths said roll formed section issuing from said drying region; and, accumulation means for accumulating for subsequent handling said predetermined lengths of roll formed section issuing from said severing means, said apparatus operating at a substantially identical line speed between an entry into said rolling mill and an exit from said severing means.

15. An apparatus as claimed in claim 14 wherein said deforming and/or shaping region removes at least portion of a layer of mill scale adhering to said steel strip under the influence of the combined effects of deformation of the steel strip and frictional engagement between rollers in said deforming and/or shaping region and the surface of the steel strip.

16. An apparatus as claimed in claim 15 wherein said sizing region removes remaining mill scale from the surface of a roll formed article under the influence of frictional engagement between rollers in said sizing region and the surface of the roll formed article in the presence of a detergent composition.

17. An apparatus as claimed in claim 16 wherein said chemical treatment region comprises means to apply a phosphate etchant to the surface of the roll formed article.

18. An apparatus as claimed in claim 17 wherein said coating application region comprises means to apply a layer of paint to the surface of the roll formed article.

19. An apparatus as claimed in claim 18 wherein said means to apply a layer of paint comprises spray painting means.

20. An apparatus for continuous in line forming and coating of roll formed articles from hot rolled steel strip, said apparatus comprising:

a roll forming mill for forming a substantially continuous roll formed section, said mill having a deforming and/or shaping region and a sizing region, said deforming and/or shaping region being adapted to remove in the presence of a mineral oil lubricating emulsion at least portion of a layer of mill scale adhering to the surface of the steel strip and said sizing region being adapted to remove in the presence of a detergent composition acting as a lubricant for sizing rolls in said sizing region the remainder of any adherent mill scale;

a chemical treatment region for chemically preparing for surface coating the surface of a roll formed section issuing from said roll forming mill;

a severing means for severing into predetermined lengths a roll formed section issuing from said chemical treatment regin;

collection means for collecting lengths of roll formed section issuing from said severing means;

transfer means for transferring individual severed lengths of roll formed section from said collection means to a conveyor means;

first conveyor means adapted to convey each said severed length of roll formed section to an entry to a painting station for sequential application of a paint coating to each said severed length of roll formed section, second conveyor means being adapted to sequentially convey to a drying region each severed length of roll formed section coated with a paint composition; and, an accumulation region for accumulating lengths of paint coated roll formed section for subsequent handling.

21. An apparatus as claimed in claim 20 wherein said first conveyor means and said second conveyor means include transversely extending knife edge support surfaces.

22. An apparatus as claimed in claim 21 wherein said knife edge support surfaces each include a notched recess for receivably locating portion of a severed length of a roll formed section.

23. An apparatus as claimed in claim 22 wherein said roll forming mill, said chemical treatment region, said severing means and said first and second conveyor means all operate at a substantially identical line speed.

24. An apparatus for surface coating of severed lengths of roll formed section issuing from a roll forming mill, said apparatus comprising:

collection means for collecting severed lengths of roll formed section issuing from a roll forming mill;

collation means for collating a plurality of severed lengths of roll formed section;

transfer means for transferring a plurality of collated severed lengths of roll formed section to a conveyor means;

first conveyor means adapted to receive and convey a collated plurality of severed lengths of roll formed section to a surface coating station;

second conveyor means adapted to receive and convey a collated plurality of surface coated severed lengths of roll formed section from said surface coating station to a drying station for drying a surface coating on said severed lengths of roll formed section.

25. An apparatus as claimed in claim 24 wherein said collation means comprises a walking beam conveyor having spaced locating means to receivably locate a plurality of severed lengths of roll formed section.

26. An apparatus as claimed in claim 24 wherein said transfer means comprises a walking beam conveyor having spaced locating means to receivably locate a plurality of severed lengths of roll formed section.

27. An apparatus as claimed in claim 24 wherein said first and second conveyor means comprise knife edge support surfaces.

28. An apparatus as claimed in claim 27 wherein said knife edge support surfaces include a plurality of spaced notched recesses to receivably locate a collated plurality of severed lengths of roll formed section.

29. An apparatus as claimed in claim 28 wherein said notched recesses include a low friction heat resistant polymeric support surface.

* * * * *